US005316399A

United States Patent [19]

Joulia

[11] Patent Number: 5,316,399

[45] Date of Patent: May 31, 1994

[54] CLOSURE DEVICE FOR A CONTAINER

[75] Inventor: Gérard Joulia, Paris, France

[73] Assignee: L'Oreal, Paris, France

[21] Appl. No.: 38,833

[22] Filed: Mar. 29, 1993

[30] Foreign Application Priority Data

Apr. 22, 1992 [FR] France ..... 92 04940

[51] Int. Cl.[5] ..... A46B 11/00; A45D 34/00

[52] U.S. Cl. ..... 401/127; 401/126; 401/129; 215/303; 220/212.5; 220/256

[58] Field of Search ..... 401/126, 127, 129; 220/256, 212.5; 215/220, 303

[56] References Cited

U.S. PATENT DOCUMENTS

| | | | |
|---|---|---|---|
| 934,657 | 9/1909 | Burgedorff | 215/303 |
| 3,726,430 | 4/1973 | Falcone et al. | 215/220 |
| 3,784,045 | 1/1974 | Komendowski | 220/256 X |
| 4,917,520 | 4/1990 | Reid | 401/127 |

FOREIGN PATENT DOCUMENTS

| | | | |
|---|---|---|---|
| 3000411 | 7/1981 | Fed. Rep. of Germany | 401/127 |
| 8914067 | 3/1990 | Fed. Rep. of Germany . | |
| 1186292 | 8/1959 | France . | |
| 1554842 | 1/1969 | France . | |
| 2585934 | 2/1987 | France | 401/127 |

*Primary Examiner*—Steven A. Bratlie
*Attorney, Agent, or Firm*—Staas & Halsey

[57] ABSTRACT

An applicator element and a cap are adapted to be mounted on a neck provided on an upper part of a container. The cap is mounted on the neck by a capsule carrying the applicator element and capable of directly ensuring closure of the container by the cooperation of a first screw thread provided on an inner surface of the capsule with a corresponding second screw thread provided externally on the neck of the container. The capsule also carries a seal adapted to cooperate with an edge of the neck when the capsule is placed on the container in the closed position. The cap is mounted on the capsule and connected to the capsule by a screw-type connection in the same direction as that of the first and second threads. The connection between the cap and the capsule offers less resistance than that between the capsule and the neck of the container.

3 Claims, 1 Drawing Sheet

CLOSURE DEVICE FOR A CONTAINER

BACKGROUND OF THE INVENTION

This invention relates to a closure device for a container comprising an applicator element.

Containers comprising an applicator element are generally small in size so that they can fit into a handbag. This is the case, e.g. with nail polish bottles. Consequently, the length of the applicator element, e.g. a brush, is limited, and when the applicator element is too short application often becomes inaccurate and difficult.

It has already been proposed to mount the applicator element carried by a closure cap slidably in the cap so as to increase the length of the stem of the applicator element outside the cap during use. This is the case, e.g. with the device described in U.S. Pat. No. 4,525,090. This solution has a number of disadvantages. Slidable mounting does not guarantee that the stem will be held in the extended position during use and, in addition, a special additional movement is required to extend the stem, which does not guarantee correct use of the device. In order to obviate the first disadvantage, it has been proposed, e.g. according to U.S. Pat. No. 4,990,014, to use a screw-type connection between the applicator element and the cap. However, this connection is independent from that between the cap and the container, so that in this case once again, extension is not automatic and correct use of the device is not guaranteed.

SUMMARY OF THE INVENTION

This invention relates to a closure device for a container having an applicator element allowing for automatic, and in particular one single rotational movement, release of the applicator element and opening of the bottle.

Thus, according to the invention, a closure device is provided for a container comprising an applicator element for reaching the fluid contained in the inner volume of the container and adapted to apply the fluid when the closure device is separated from the bottle. The device comprises a cap adapted to be mounted on a neck provided on the upper part of the container, is characterised in that the cap is mounted on the neck by a capsule carrying the applicator element and is capable of directly ensuring closure of the bottle by the cooperation of a screw thread provided on an inner surface of the capsule with a corresponding thread provided externally on the neck of the bottle. The capsule also carries a seal adapted to cooperate with edge of the neck when the capsule is in place on the bottle in the closed position. The cap is mounted on the capsule and connected to the capsule by a screw-type connection in the same direction as that of the threads, such that the normal rotational movement applied to the cap to separate the closure device from the container results first in axial displacement of the cap with respect to the capsule, and then in the capsule being unscrewed from the neck, the connection between the cap and the capsule offering less resistance than that between the capsule and the neck of the container.

The seal is advantageously carried by the applicator element.

The cap is preferably provided internally with a thread cooperating with a thread provided externally on the capsule, the lower resistance offered by the connection between the cap and the capsule being obtained by the pitch of these threads, which is larger than that of the other threads.

This invention also relates to a container provided with a closure device according to the invention.

BRIEF DESCRIPTION OF THE DRAWINGS

The object of the invention will be more readily understood from the following description of one embodiment given purely by way of a non-limiting example and illustrated in the accompanying drawings, in which.

DESCRIPTION OF THE PREFERRED EMBODIMENTS

Figure 1:
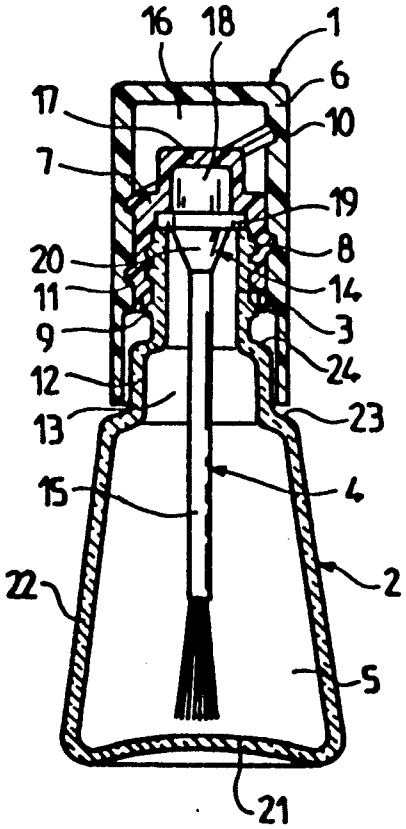
FIG. 1 is an axial section of the closure device 1 provided on a bottle.

Referring to FIG. 1, the closure device 1 is mounted on a container formed by a bottle 2, the volume 5 of which is filled with a liquid to be applied, e.g. a nail polish. As is usual, the bottle 2 has a trapezoidal base 22 connected at 23 to a sub-collar 12, the volume 13 of which is an additional volume for the liquid contained in the bottle. The sub-collar 12 is connected at 24 to a neck 3, the outer surface of which is provided with a screw thread 9.

An applicator element 4 for the application of nail polish comprises a brush 15 topped by a mounting head 14 having a truncated portion 20 for connecting the brush 15 to a circular plate 19, the diameter of which is approximately equal to the outer diameter of the neck 3, and in any case greater than the diameter of the orifice defined by the said neck 3, so that the plate 19 closes the neck 3 in a sealed manner. The plate 19 is topped by a cylindrical end piece 18.

A capsule 7 of generally cylindrical shape closes the bottle in a sealed manner. To this end, it is provided on its inner face with a thread 8 which cooperates with the thread 9 of the neck 3. The upper part of the capsule 7 is cap-shaped 17 and receives the cylindrical end piece 18 of the mounting head 14 of the applicator element 4. It will be seen that when the capsule 7 is screwed on to the neck 3 of the bottle, the capsule applies the sealing plate 19 to the edge of the neck 3 and closes the container 2. In this position, the lower end of the brush 15 is close to the bottom 21 of the container 2.

According to an advantageous arrangement of the invention, the closure device 1 has a cap 6 in the shape of a cylinder closed at 16 in its upper part. The inner cylindrical surface of the cap 6 is provided with a thread 10 which cooperates with a thread 11 provided on the capsule 7 on its outer cylindrical face. The threads 10 and 11 are in the same direction as the threads 8 and 9.

When the cap 6 is screwed on to the capsule 7, the cap extends at right angles with the sub-collar 12 as far as the connecting zone 23 of the base 22 and the sub-collar 12. This is the position shown in FIG. 1.

Figure 2:
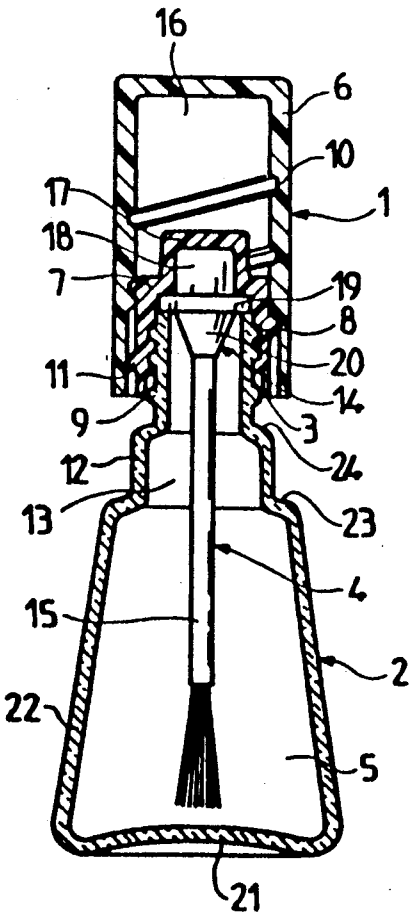
FIG. 2 is similar to FIG. 1, the cap being extended.

The pitch of the threads 10 and 11 is greater than that of the threads 8 and 9. Consequently, when a rotational movement is applied to the cap 6 in order to unscrew the closure device 1, the threads 10 and 11 offer less resistance than the threads 8 and 9. Thus, in a first stage, the cap 6 is unscrewed from the capsule 7 and moves axially away from the container until the run-out of the threads 10, 11. This is the position shown in FIG. 2. The capsule 7 is then unscrewed from the neck 3 of the container when the rotational movement is continued. At the end of the movement, the closure device 1 is separated from the container. This is the position shown in FIG. 3.

Figure 3:
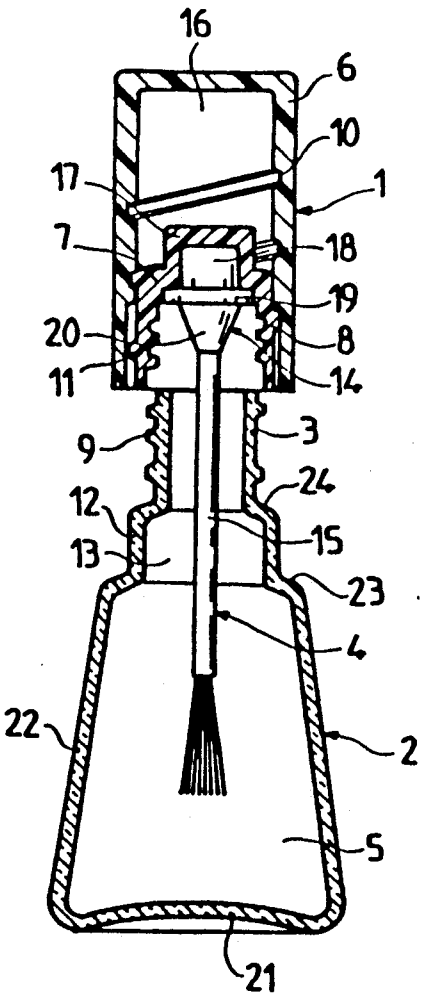
FIG. 3 is similar to FIG. 1, the closure device being released from the bottle.

It will be noted that, on the one hand, in the closed position shown in FIG. 1, the closure device 1 has very small axial dimensions and that, on the other hand, in the operating position of the applicator element shown in FIG. 3, the latter is provided with a gripping element of appropriate length, formed by the cap 6. It will also be noted that the passage from the closed position to the operating position is effected automatically, by the usual single movement for unscrewing the closure device from the bottle.

I claim:

1. Closure device for a container, comprising: an applicator element for reaching fluid contained in an inner volume of the container and adapted to apply the fluid when the closure device is separated from the bottle;

a cap adapted to be mounted on a neck provided on an upper part of the container, wherein the cap is mounted on the neck by a capsule carrying the applicator element and capable of directly ensuring closure of the bottle by the cooperation of a first screw thread provided on an inner surface of the capsule with a corresponding second thread provided externally on the neck of the bottle, wherein the capsule also carries a seal adapted to cooperate with an edge of the neck when the capsule is in place on the bottle in the closed position, and wherein the cap is mounted on the capsule and connected to the capsule by a screw-type connection in the same direction as that of the first and second threads, such that the normal rotational movement applied to the cap to separate the closure device from the container results in an initial axial displacement of the cap with respect to the capsule which causes the removal of the cap from the container, and then results in the capsule being unscrewed from the neck, the connection between the cap and the capsule offering less resistance than that between the capsule and the neck of the container.

2. Closure device according to claim 1, wherein the seal is carried by the applicator element.

3. Closure device according to claim 2, wherein the cap is provided internally with a third thread cooperating with a fourth thread provided externally on the capsule, the lower resistance offered by the connection between the cap and the capsule being obtained by a pitch of the third and fourth threads, which is larger than that of the first and second threads.

* * * * *